United States Patent [19]

Miller

[11] Patent Number: 4,928,966

[45] Date of Patent: May 29, 1990

[54] GROUND SIMULATOR

[76] Inventor: Omer E. Miller, 416 Dunes Wildwood Trail, Myrtle Beach, S.C. 29577

[21] Appl. No.: 327,136

[22] Filed: Mar. 22, 1989

[51] Int. Cl.[5] ..... A63B 69/36

[52] U.S. Cl. ..... 273/195 A; 273/186 R

[58] Field of Search ..... 273/195 R, 195 A, 186 R, 273/183 A, 187 R

[56] References Cited

U.S. PATENT DOCUMENTS

| | | | |
|---|---|---|---|
| 3,473,811 | 10/1969 | Lees | 273/195 R |
| 3,712,628 | 1/1973 | Boss | 273/195 A |
| 4,130,283 | 12/1978 | Lindquist | 273/195 A |
| 4,311,312 | 1/1982 | O'Brien | 273/195 A |
| 4,387,896 | 6/1983 | O'Brien | 273/195 A |

*Primary Examiner*—George J. Marlo

*Attorney, Agent, or Firm*—Bacon & Thomas

[57] ABSTRACT

A Ground Simulator for hitting and for practicing self shots of various types comprising, a frame, and multiple layers which are disposed in spaced relation to each other on the frame. Resilient members are used to connect the layers to the frame and to adjust the relative tension of each of the layers.

Additionally, a fixed base attachment for operative connection the Ground Simulator as above described including, a base having connectors to enable the fixed base attachment to be fixed to any type of surface, and guide means on the Ground Simulator and the base for restricting the sideways movement of the ground simulator.

Additionally, a Ground Simulator as above described in combination with a stance assembly including, a connecting means for connecting the stance area to the Ground Simulator, and a top standing layer to adjust the relative position and height of the stance area relative the upper surface of the Ground Simulator.

19 Claims, 8 Drawing Sheets

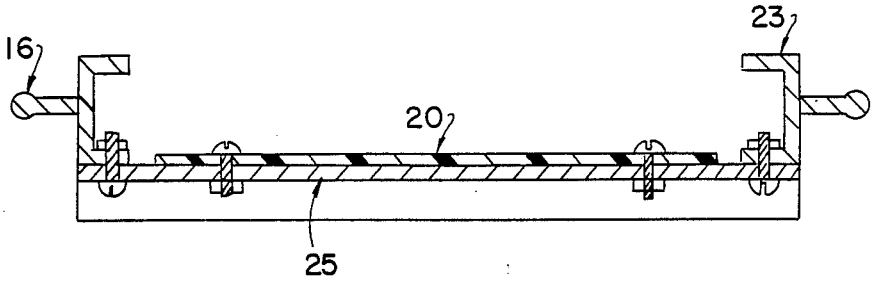
FIG. 10
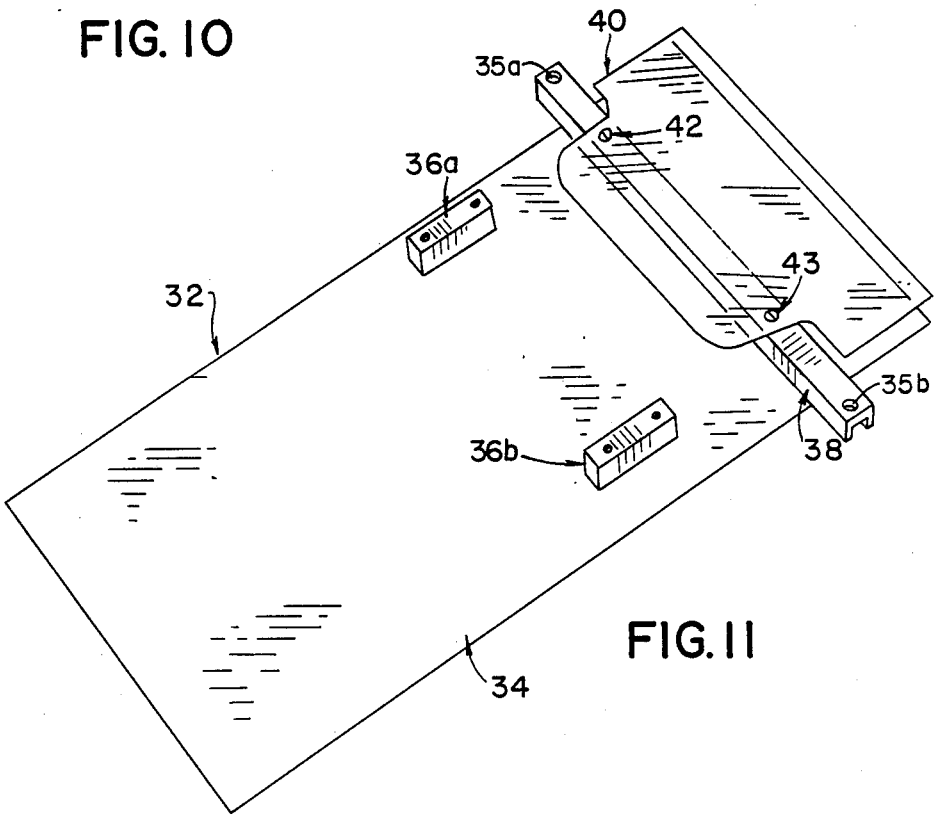
FIG. 11
FIG. 12
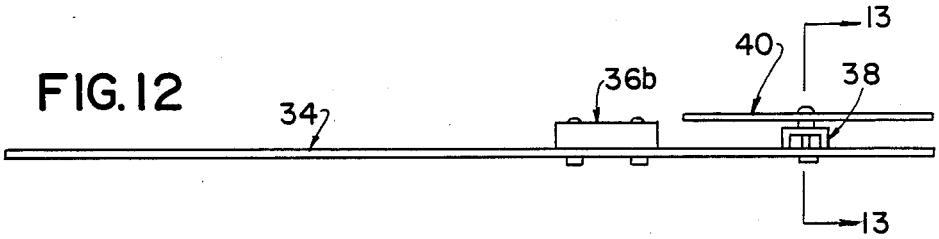

FIG. 13
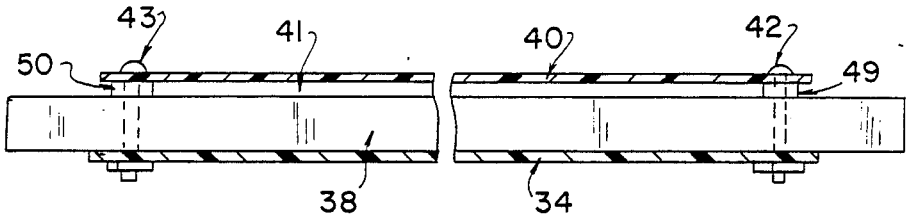
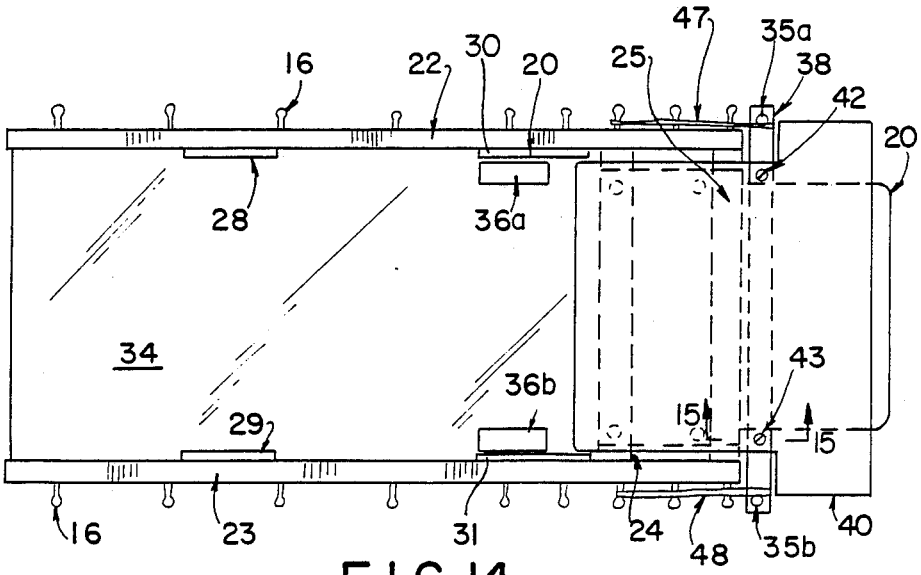
FIG. 14
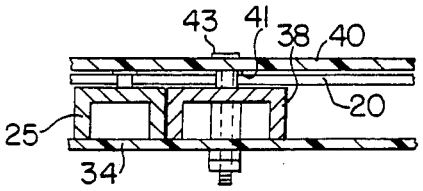
FIG. 15

FIG. 18
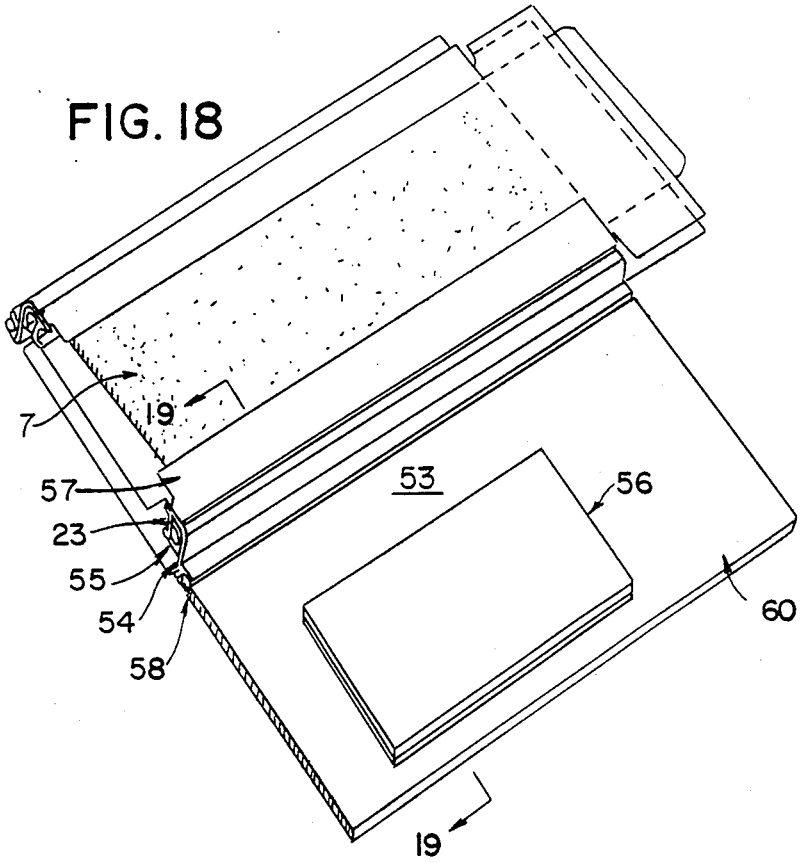
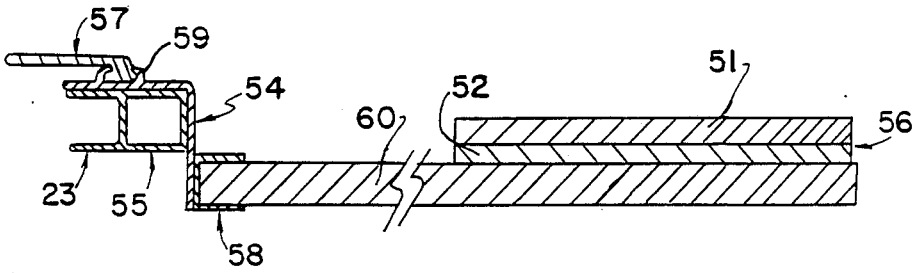
FIG. 19

GROUND SIMULATOR

BACKGROUND OF THE INVENTION

This invention relates generally to a device for hitting golf shots and more particularly to a Ground Simulator which is alternatively and selectively portable or fixed for hitting golf shots off of any type of surface or for practicing golf shots so as to permit a golfer to hit down through the ball without undue stress or strain on the golfer's wrists and arms.

The assembly in accordance with the present invention is adjustable and capable of simulating ground surfaces of various type and in one preferred form by reason of its portability enables the golfer to hit a shot, move the Ground Simulator to a further location and then hit another shot so that the golfer can play a round of golf where for example, the turf is frozen, the course turf requires protection during periods of repair or periods when the turf on a particular course is wet and marshy, or the course has holes made of sand or clay as exists or is contemplated in Middle East, Australia or other countries.

Further however, this adjustable Ground Simulator is alternatively and selectively, adaptable, adjustable, and modifiable as a practice device to permit a golfer when hitting a practice ball to achieve substantially the same feel and reaction as occurs when hitting under actual fairway, rough, sand traps, and other golf course ground conditions.

By modifying the portable Ground Simulator with suitable attachments, it can be fixedly connected at a predetermined area on the golf course, or in a practice area or space to provide an improved practice facility.

In regard to utilizing the Ground Simulator in accordance with the present invention as a hitting assembly for use at times and under the varying conditions which restrict the golfers opportunity to play, those skilled in the art will readily recognize that golfers of all nations are avid athletes. Thus, at all times and under all but the most stark and adverse conditions seek to enjoy the pleasure and rewards which grow from a round of golf. It is well recognized that the anticipated enjoyment of such round of golf is curtailed in those places where the turf of the golf course becomes frozen, or is softened by rain or flooding which renders at least portions of the golf course unplayable, or when due to excessive play or other conditions maintenance and repair is required to the grasses which provide the turf conditions on which the game of golf is played.

Additionally, it is also known that in countries where sand or clay is an inherent ground condition that the building of golf courses is limited and the maintenance thereof extremely difficult.

There are at present no easily available and reasonably priced commercially feasible devices or assembly which enable a golfer to simulate the ground surface conditions and the hitting of a golf shot which imitates hitting off of these various surface conditions.

Similarly, there are no easily available and reasonably priced convenience devices which act to simulate ground surface conditions at a golf course on which a golfer can practice golf shots.

In regard to the practice of golf shots various commercial devices are known. Thus in present day driving ranges, indoor practice areas, and at some golf courses, mats are used in a hitting area for confined golf practice activities. These mats are generally made of plastic and consist of either "ASTROTURF" or brush. The plastic fibers from which the mats are made are laminated with melted resin to form a rubberized cushion. The mats may be joined in two or more units, fastened together mechanically, or adhesively connected to surfaces such as cement, asphalt, wood, or even the ground. This type of construction permits very little movement in any direction especially up and down, and the units are stiff, rigid and stable in order to give them long life.

By reason of this limited up, down, and sidewise movement, these prior art mats cannot impart the sensation of actual ground conditions on a golf course when a golfer hits a practice ball on such mats. Any practice shot on such prior art mats which would for example, normally create a divot if made on actual turf causes the club head to skip, slide or stop abruptly. This not only causes an unpleasant sensation, but also puts abnormal strain on the golfers hands, wrists, and elbows, which in some instances may be injurious.

For this reason practically all prior art practice devices are also generally provided with some means of teeing the ball up when the mat is in use. This type of arrangement makes it acceptable and natural for hitting balls with a wooden club such as a driver, but is not adaptable for simulating ground conditions for practicing shots using fairway woods or higher angle irons, nor is it possible to effectually practice chipping or explosion type sand shots.

The alternative to this arrangement is to maintain a practice area on natural turf, a sand trap, or other ground conditions which is restrictive because of the land area required and the problems of growing turf to replace the turf where divot shots, for example, are practiced.

The present invention seeks to overcome all these above enumerated problems by providing a Ground Simulator which has the ability to imitate the feel of actual ground conditions on a golf course because the parts and elements of the Ground Simulator in accordance with the present invention whether in portable or a fixed assembly form, as hereinafter more fully described, creates a striking surface capable during any hitting or practice shot of instantaneous movement to absorb the initial kinetic energy of the club head and thereafter will exert the desired resistance by moving in an up, down or sidewise direction to accommodate the particular shot being made.

This instantaneous movement of the assembly and striking surface of the Ground Simulator in accordance with the present invention to enable the kinetic energy of the club head to be absorbed followed by the action to impart resistance to the club head during any particular hitting or practice shot thereon is diametrically opposite and different from the prior art devices which offer only instantaneous resistance to the club head and thus cause the above mentioned discomfort and potential injury to the golfers hands, wrists, and elbows.

This is accomplished in the Ground Simulator in accordance with the present invention by providing a plurality of resiliently suspended layers of material so disposed in spaced relation that the suspended layers are capable of operative interrelation to accept, conform and deform to any particular sole design of a club head and to move up, down, forwards, backwards, and from side to side, as the hitting of a golf ball either on a golf course or under practice conditions where the Ground Simulator is being used, may require.

In the Ground Simulator in accordance with the present invention, the top layer will respond to the exact direction of the club head, and as the club head continues on toward the target and the trajectory is downward the underneath side of the top layer will create a sliding frictional contact with the top of at least one of the intermediate or lower coacting layers. Thus, the top layer and the intermediate layers will work in unison. Further, if the downward deflection is great enough, a similar interaction occurs with the bottom layer at which time the intermediate and bottom layers will be acting in unison responding to the various directions of movement and the forces being exerted. by the club head during hitting of the golf shot.

Of particular importance is the fact that when the practice stroke is completed, the coacting top, the intermediate and the bottom layers made generally of plastic and resilient materials all return to their original position ready for another hitting or practice stroke.

The present invention is characterized by the fact that the golfer gets the feel from the practice stroke and the stroke telegraphs the general degree of precision after it is completed. Further since there are individual differences in feel from various ground conditions, the present invention includes means for adjusting this feel for example by changing the spaced distances between the top, intermediate and bottom layers of material, by changing the tension of the connecting devices used for mounting the respective layers in the Ground Simulator, by adjusting the thickness and resiliency of one or more of the respective top, intermediate and bottom layers, and the height of the supporting feet. Resiliency can make the portable form of the Ground Simulator, as hereinafter more fully described, movable in all directions and dimensions to help absorb the initial kinetic energy of any shot being made thereon.

Additional methods of changing the feel of the Ground Simulator in accordance with the present invention includes changing the rug material used for the various layers. For example, different resistances will be encountered by the golf club on any particular shot depending on the thickness, nap, backing or weave of the top layer's carpet. Fine tuning to adjust the feel of the hitting or practice shot off of the Ground Simulator may be made by changing some of these factors, the parts, and their operative interrelation, or by a combination of such changes.

In its basic mode or form, the Ground Simulator in accordance with the present invention contemplates the adjustable multi-layered assembly as above described which is made of relatively light materials so that it weighs approximately three to four pounds and thus is portable and can be carried about where the conditions of the particular golf course being played so requires, to permit the golfer to hit shots under conditions which simulate the corresponding course conditions at the point where the shot is struck. Alternatively, the Ground Simulator can be used for hitting practice shots in any preselected confined area and off of any type of surface present in such area.

In a second mode, the basic portable Ground Simulator can be operatively associated with and slidably mounted in a base attachment which is provided with means for fixedly connecting the combined units to a given surface where the golfer desires to practice hitting shots. The base attachment and the Ground Simulator have coacting guide means for maintaining the Ground Simulator in register and in alignment with the base attachment during use, and the Ground Simulator and base attachment are so connected that the base attachment acts to return the Ground Simulator to the original position after the practice shot is completed.

In a third mode the basic portable Ground Simulator as above described may be operatively connected to a stance assembly and when properly attached, prevents the Ground Simulator from creeping forward or changing position when it is either used for hitting golf shots or for practicing shots. The stance assembly acts as a temporary means for fixing the Ground Simulator because of the weight of the golfer standing on the stance area. This third mode is particularly useful where multiple successive balls are hit off of a hard concrete surface into an associated catching net for trapping the balls when hit.

In a fourth mode, the stance area may be added to the coacting combination of the basic portable Ground Simulator and base attachment to enhance practicing golf shots.

Further, the stance assembly can be so adjusted or built up that the shots that are practiced by the user of the present device can be done either at ground level or can simulate a side hill or downhill lie for purposes of practicing shots under these conditions.

SUMMARY AND OBJECTS OF THE INVENTION

Thus, the present invention covers an improved portable Ground Simulator which includes, a frame, and a plurality of flexible layers. The layers are stretched across the frame, and are in spaced relation to each other. The uppermost layer is made of a resilient carpet-like material, and is adapted to hold a golf ball in place and absorb the impact and wear of numerous practice sessions. The layers are held on the frame by a multitude of connecting means, with one end of the connecting means attached to its respective layer and the other end attached to the frame. The tension in the connecting means can be adjusted, thus changing the tension within the layers.

Additionally, the present invention covers the portable Ground Simulator as above described in combination with a base attachment which can be fixedly connected to any surface, the base attachment and the Ground Simulator are operatively and slidably assembled and connected to permit relative movement of the Ground Simulator with respect to the base attachment, the base attachment and the Ground Simulator having guide means thereon to enable the Ground Simulator to travel forwards and backwards without material sidewise movement, and the means connecting the Ground Simulator to the base attachment permits the Ground Simulator to return to its original position relative the base attachment after a practice shot is completed An optional attachment for the portable Ground Simulator or the combined portable Ground Simulator and base attachment, all as above described, is a stance assembly. The stance assembly includes, a reversible platform with a frictional layer, a middle layer of sturdy material, and a top standing layer. The platform is connected to the fixed base attachment by any suitable form of connecting device.

Accordingly, it is an object of the present invention to provide a relatively light portable assembly which simulates ground conditions on a golf course off of which a golfer can hit golf balls where required on an actual golf course or alternatively and selectively which can be used on any surface for practicing golf shots from any given indoor or outdoor practice area.

It is another object of the present invention to combine a relatively light portable assembly which simulates ground conditions on a golf course with a base attachment with means for fixedly connecting the portable Ground Simulator in a given area or space to permit use thereof for hitting practice balls.

It is another object of the present invention to provide a portable Ground Simulator having a plurality of interacting and adjustable layers which can be set at varying tensions so that different types of ground conditions can be simulated.

A further object of the present invention is to provide a surface that can quickly and easily provide varying types of lies for the practice shot.

Still a further object of the present invention is to provide an apparatus which is portable and can be easily moved and used no matter what terrain the apparatus is placed upon.

BRIEF DESCRIPTION OF THE DRAWINGS

FIG. 10 is a cross-section taken at line 10—10 on FIG. 3 with the top, middle and bottom layers removed;

FIG. 11 is a perspective view of the base attachment shown in FIG. 1;

FIG. 12 is a side view of the base attachment shown in FIGS. 1 and 11;

FIG. 13 is a cross-section taken at line 13—13 on FIG. 12.

FIG. 14 is a top view of the Ground Simulator in operative relation with the base attachment with the layers and connecting means of the Ground Simulator removed.

FIG. 15 is a cross-section taken at line 15—15 on FIG. 14.

FIG. 18 is perspective view of the Ground Simulator in operative association with the base attachment and a stance area for right hand hitters FIG. 19 is a enlarged cross-section taken at line 18—18 of FIG. 18.

DETAILED DESCRIPTION OF THE PREFERRED EMBODIMENTS

Figure 1:
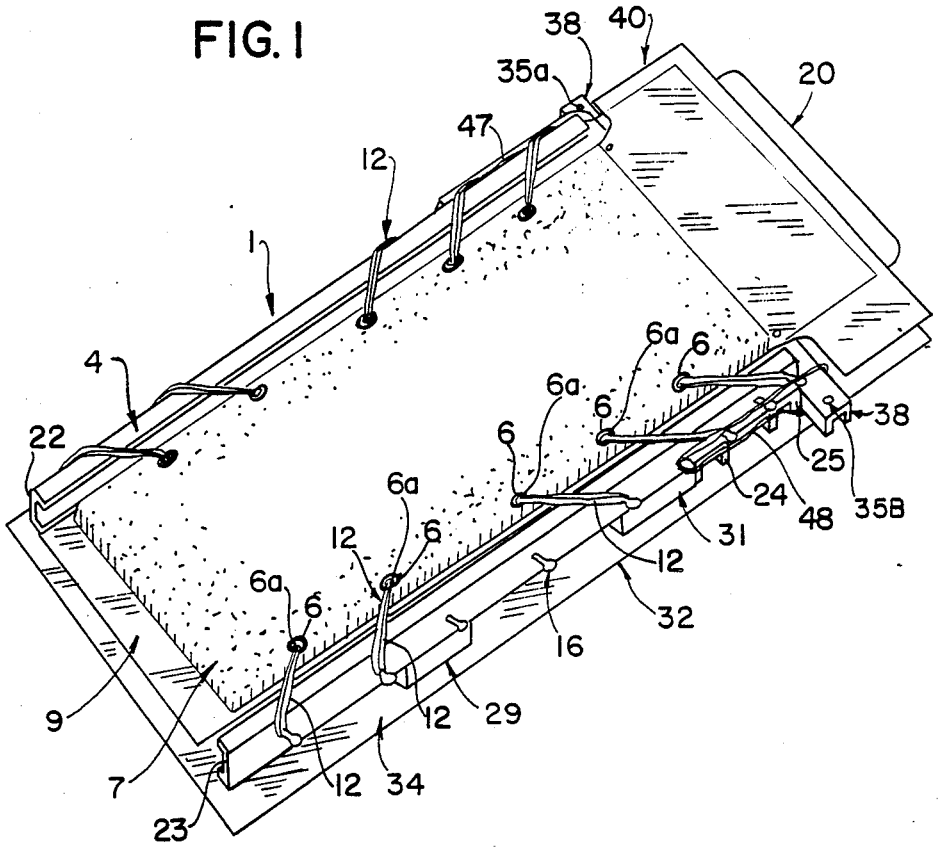
FIG. 1 is a perspective view of one preferred embodiment of a portable Ground Simulator in accordance with the present invention in operative relation with one form of base attachment.
Figure 2:
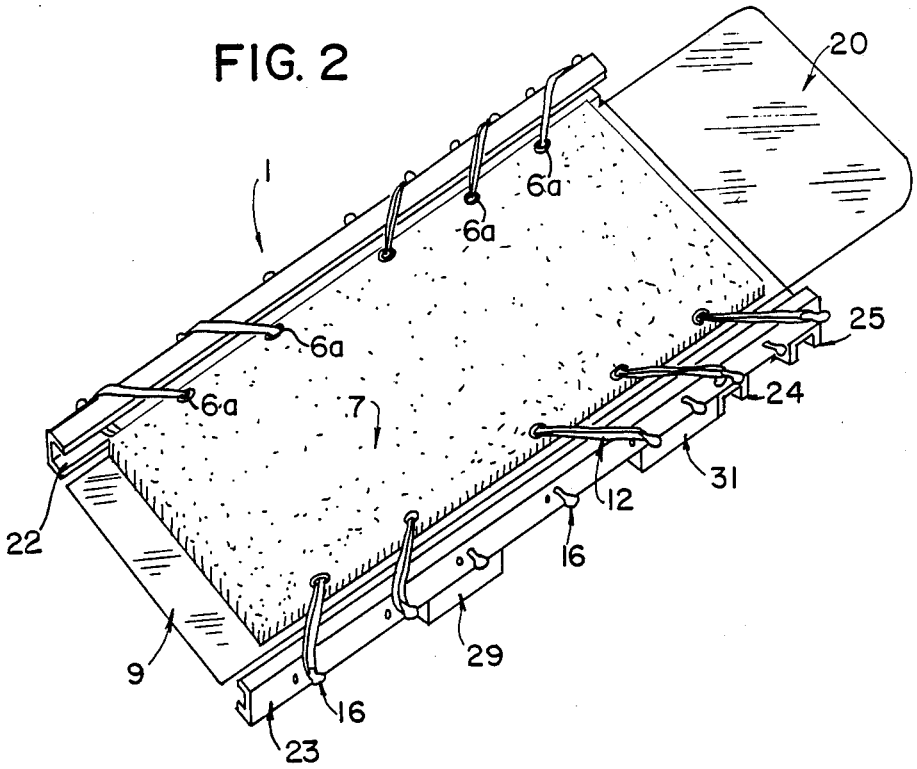
FIG. 2 is a perspective view of the Ground Simulator shown in FIG. 1.
Figure 3:
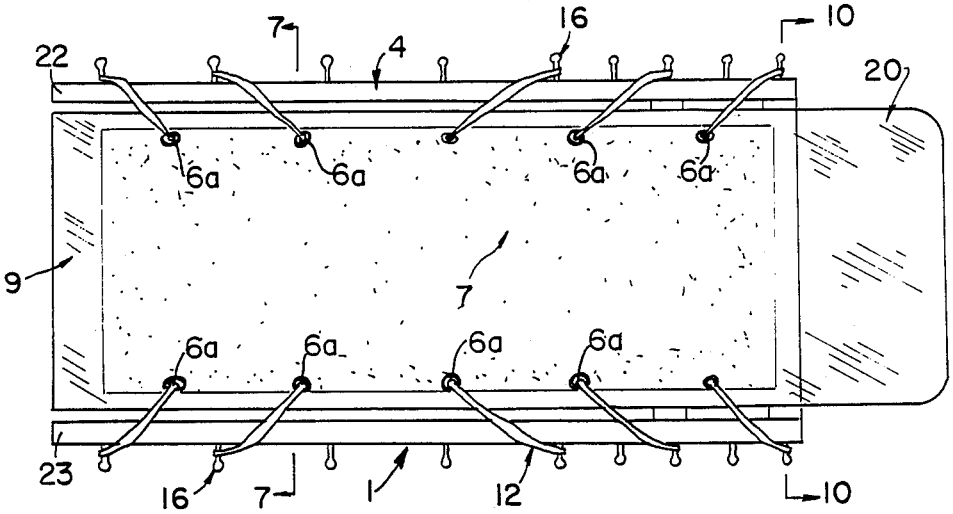
FIG. 3 is a top view of the Ground Simulator shown in FIGS. 1 and 2.
Figure 4:
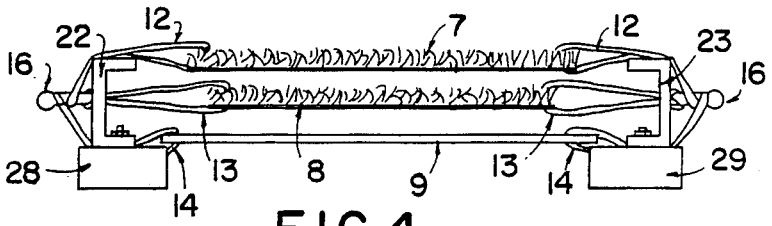
FIG. 4 is a front end view of the Ground Simulator shown in FIGS. 1 and 2.
Figure 5:
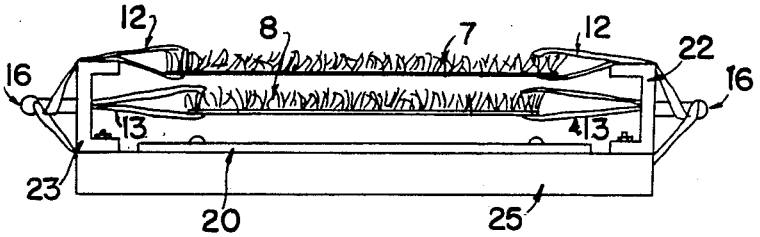
FIG. 5 is a back end view of the Ground Simulator shown in FIGS. 1 and 2.
Figure 6:
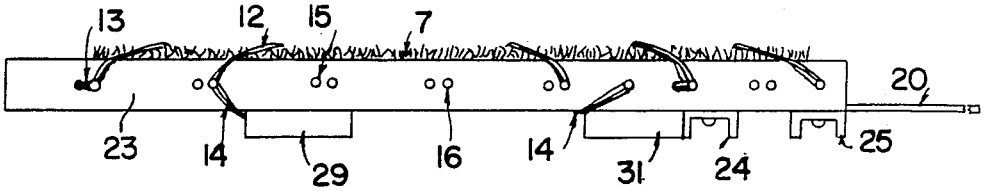
FIG. 6 is a side view of the Ground Simulator shown in FIGS. 1 and 2.
Figure 7:
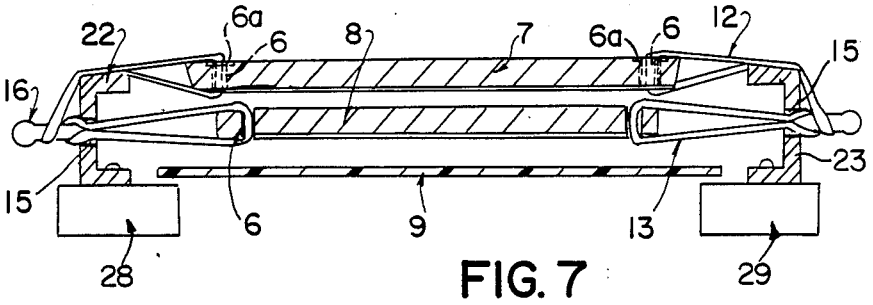
FIG. 7 is a cross-section of line 7—7 of FIG. 3.
Figure 8:
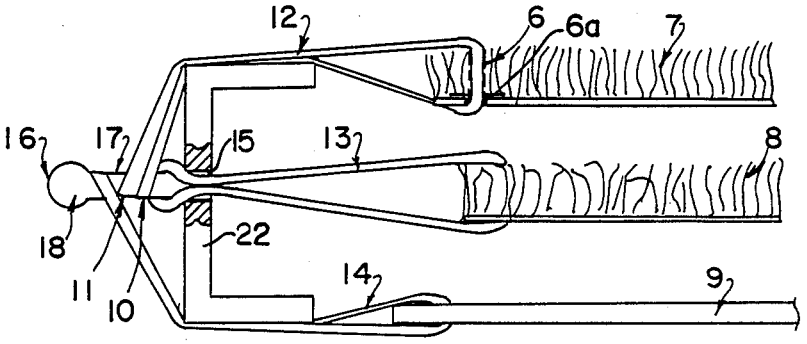
FIG. 8 is an enlarged fragmentary cross-section showing the holding member and the connecting means for the top, middle and bottom layer of the Ground Simulator in accordance with the present invention.

Referring to the drawings, FIG. 1 shows a preferred form of portable Ground Simulator generally designated 1 and a base attachment generally designated 32 which are combined for operative association.

Those skilled in the art will readily recognize and understand that the portable Ground Simulator is intended and can be used apart from the base attachment without departing from the scope of the present invention and that the figures of the drawings showing the portable Ground Simulator and base attachment together are used to simplify the description of the various modes and forms in which the portable Ground Simulator in accordance with the invention as above described is capable of functioning.

FIGS. 2 to 10 show that the portable Ground Simulator 1 includes, frame 4, coacting layers 7, 8, and 9, connecting means 12, 13 and 14, holding bolts 16, and ramp 20.

Figure 9:
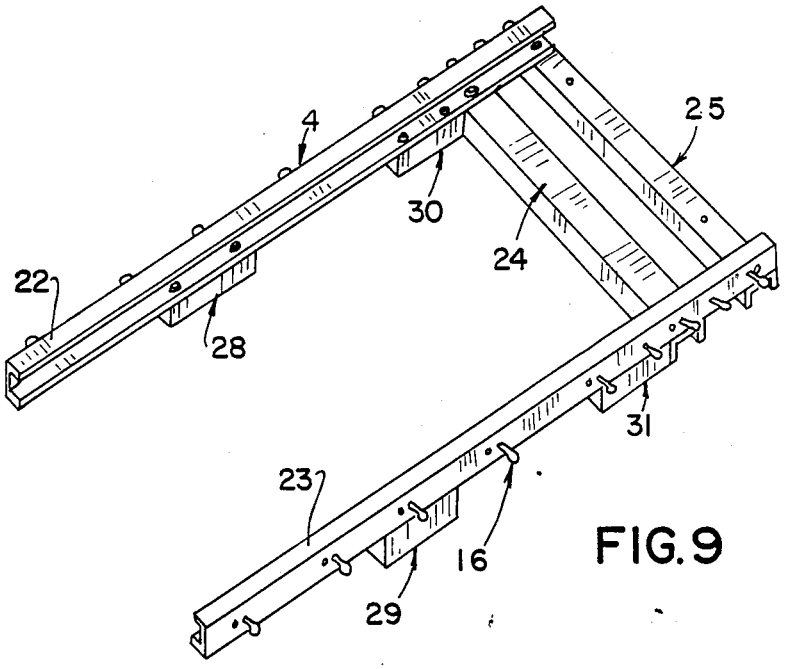
FIG. 9 is a perspective view of the frame for the Ground Simulator shown in FIGS. 1 to 8 of the drawings.

By reference to FIG. 9, the frame 4 comprises a pair of spaced generally portable channel members 22 and 23, and a pair of spaced generally parallel cross members 24 and 25. Fastened to the sides of each of the respective channel members 22 and 23 are a plurality of externally projecting holding bolts 16, whose purpose will be described below. At one end of the frame 4, the cross members 24 and 25 are attached at opposite ends to the respective lower faces of the pair of channel members 22 and 23 and the ramp 20 is attached at one end to cross member 25. At the other end of the frame 4 feet 28 and 29 are attached to the lower faces of the respective spaced channels 22 and 23. Spaced therefrom and connecting to the channels 22 and 23 in the same plane are feet 30 and 31 which act to support and keep the Ground Simulator from tipping when placed on any surface for use. When the portable Ground Simulator is used with the base attachment, the members 30 and 31 also act as guide members with coacting members on the base attachment as will be more fully described below.

The three coacting layers 7, 8, and 9 are mounted in the frame 4. Stretched across the top of the frame 4 is layer 7, both sides of which are attached to the frame by a plurality of tension adjustable connecting means 12. Top layer 7 is made of a material sufficiently rough enough to keep a golf ball in place, such as a carpet. The connecting means 12 are made of a resilient material, and can be of variable tensions so that different types of ground conditions can be simulated. For example, in the preferred embodiment, rubber bands easily purchased on the open market are used, as is shown in FIGS. 1, 2, 3, 4, 5, 6, 7, and 8 of the drawings.

FIGS. 4, 5, 7, and 8 show that one end of the connecting means 12 is attached to the layer 7 at one of the holes 6, and the other end of the connecting means are attached to a holding bolt 16. If rubber bands are used, a possible method is to loop rubber band end 10 around holding bolt 16, and insert the rubber band end 11 through hole 6 protected by grommet **6*a* and then also around holding bolt 16. The holding bolts 16 are designed to hold one end of the connecting means 12. One possible embodiment of the holding bolts has a rod 17 connected at one end in the channel member 23 and provided at the opposite or outer end with a knob 18. The connecting means can be looped around the rod 17 while the knob 18 functions to keep the connecting means 12 from slipping off the holding bolt 16, as is clearly shown in FIG. 8** of the drawings.

Layer 8 is also made of a material such as a carpet which may be thinner or thicker than layer 7. The surface of layer 8 must be such that it will permit sliding and limited frictional engagement between layer 7 and layer 8 during the use of the portable Ground Simulator 1 for the alternate and selective hitting shots or practicing shots for which the portable Ground Simulator can be used.

Layer 9 is preferably made of a plastic material which is capable of interaction with the lower bottom face of the intermediate layer 8 to provide a low degree of sliding friction during use of the portable Ground Simulator 1. The lower layer 9 in addition to its interaction with intermediate layer 8 and top layer 7, also serves to protect the surface on which the portable Ground Simulator is placed during the alternate and selective use which can be achieved in accordance with the present invention.

Layers 8 and 9 can be connected to the frame 4 in the same manner as discussed above for layer 7. The connecting means 13 for the middle layer 8 passes through holes 15 in the frame 4 before being connected to holding bolt 16. Connecting means 14 of bottom layer 9 travel under the frame 4 before being connected to holding bolt 16.

BASE ATTACHMENT

Base attachment 32 serves a two-fold purpose. First, it provides means to enable the combined portable Ground Simulator and base attachment to be fixed in place to facilitate use of the portable Ground Simulator as above described for hitting or practicing golf shots from a predetermined indoor or outdoor area or space. Second, it enables the portable Ground Simulator to be so slidably mounted in the base attachment that it permits to and fro movement of the portable Ground Simulator in this fixed location so that it is free to provide the operative interrelation of layers 7, 8 and 9 for results achieving the advantageous end results in accordance with the present invention.

FIGS. 11, 12, and 13 show base attachment 32 as including, a base sheet 34. Base sheet 34 is a semi-resilient plastic sheet. Fastened to the top of base sheet 34 are a pair of spaced guide members **36*a* and 36*b*. The guide members 36*a* and 36*b* are short plastic blocks and the transverse distance between the outer faces of the spaced pair of guide members 36*a* and 36*b* is such that when the portable Ground Simulator is in assembled position on the base attachment, the outer faces are in sliding fit engagement with the inner faces of feet 30 and 31. Attached on top of base sheet 34 is stop member 38. Stop member 38 is an aluminum channel and one end of the base ramp 40 is attached to stop member 38 by means of threaded members 42 and 43. As shown in FIG. 13, the base ramp 40 and stop member 38 are held in spaced relation by washers 49 and 50 to keep the lower face of the base ramp 40 from contacting the upper face of the stop member 38 and thus forms a space 41 therewith having a sized vertical dimension as a function of the thickness of the washers 49 and 50. Bolts 42 and 43 serve to define the width of the space 41 which is slightly larger than the width of ramp 20 to enable the portable Ground Simulator to be positioned in the base attachment 32**.

The base attachment 32 can be anchored to the ground by driving any suitable attaching means such as a spike or bolt not shown through the spaced anchor holes **35*a* and 35*b* into the surface on which the combined Ground Simulator and base attachment is being used. Ground Simulator 1 is positioned in the base attachment 32 so that the inside faces of feet 30 and 31 are in sliding engagement with the outside faces of guide members 36*a* and 36*b*. Also, ramp 20 is disposed to slide into the space 41 formed on the base attachment 32. The base ramp 40, being of a pliable material, will rest on the ramp 20, all of which is shown in FIGS. 1, 10, 11, 12, 13, 14 and 15** of the drawings.

FIGS. 1, 14, 16, and 17 further show that when Ground Simulator 1 is in assembled position for use cross member 25 abuts stop member 38. In this position one projecting end of stop member 38 can be fitted with a first resilient returning device, such as a rubber band 47 which is wrapped around one end of stop member 38 and an associated holding bolt or bolts 16 on the channel on the same side of the frame 4. Similarly, the other end of stop member 38 can be joined by rubber band 48 with a holding bolt or bolts 16 on the channel on the opposite side of frame 4.

OPERATION

It is first noted that whether the portable Ground Simulator is mounted in the base attachment 32 or not the basic operative interrelation between layers 7, 8 and 9 will be the same.

The following illustration shows one way in which the portable Ground Simulator can be used. The golfer pulls a ball along the ground, up onto ramp 20, and then onto the top layer 7, or if the base attachment is being used, the golfer can pull the ball up base ramp 40. With the ball in place, the golfer can now swing at the ball the way he might if the ball was on a given surface, ground or turf conditions present on a golf course. The club head will initially push against the top layer 7. However, because of the structure of the Ground Simulator there is an instantaneous absorption of the kinetic energy of the club head before the top layer exerts resistance to the forward movement of the club head into the striking surface of top layer 7. Thus, as the club head continues its downward motion, the layer will conform to the club head's shape, and provide an upward resistive force. If the downward deflection is great enough, the second layer 8 will be reached and it will work in unison with the top layer 7. A similar effect may be produced in the bottom layer 9, depending on the path of the swing. Layers 7, 8, and 9 and base sheet 34 are made of materials which will allow one layer to slide along the next lowest layer, so that there is limited interlayer resistance, the layers do not fold upon themselves or restrict the forward movement of the club. This slidable contact is most prevalent between the carpet-like middle layer 8 and the plastic bottom layer 9 because of the bottom layer's smooth surface. However, some lateral resistance is encountered by the upper two layers 7 and 8 in contact with each other because of their carpet-like characteristics. Therefore, the portable Ground Simulator approximates the varying vertical and horizontal resistances encountered with actual surface, ground or turf conditions on a golf course.

The operation as above described is very similar to the action of a club head taking a divot through ordinary turf. The resistance to the club head increases as the club head moves into the top layer or more deeply below the ball. Additionally, the versatility of the layers 7, 8 and 9 and their operative interrelation accommodates practice shots in which the club head travels across the face of the ball being struck.

In the Ground Simulator in accordance with the present invention, the resistance of layers 7, 8 and 9 communicated to the club head can be changed to simulate the individual differences of various types of terrain. One method of changing the tension within the layers is by changing the position and tension exerted by the connecting means 12, 13 and 14. Moving the connecting means 12, or 13 or 14 from one holding bolt 16 to another holding bolt 16 will change the tension within the connecting means, and consequently, the tension within its respective layer. Another method of changing the tension within the layers is to remove or add more connecting means. Still another method would be to increase or decrease the spaces between the layers 7, 8 and 9, or by removing a layer. For example, reducing the tension or forces exerted on layer 7 and removing the middle layer 8 would simulate hitting an explosion shot from a sand trap.

A spacing of 1.5" to 2" between the top and bottom layers regardless of the presence of a middle layer is recommended.

Another way to adjust or to change the feel communicated to the club head is to increase or decrease the vertical thickness of the feet 28, 29, 30 and 31, or use feet having a different configuration or compressible material.

Total displacement of layers 7, 8 and 9 is in part a function of the vertical thickness or dimension of the respective feet 28, 29, 30 and 31. Total displacement, i.e., the up and down movement of the Ground Simulator is equal to the sum of the thickness of the interacting layers 7, 8 and 9, less the vertical dimension of feet 28, 29, 30 and 31.

The object in adjusting resistance and/or the feel communicated to the club head is essentially a combination of the up and down movement of layers 7, 8 and 9, and the forward motion both initially where the kinetic energy of the club head is absorbed and the continuing forward motion during the practice stroke.

When the portable Ground Simulator 1 is assembled in the base attachment 32 the operation as above described is equally applicable to the portable Ground Simulator, however because of the operative interrelation between the Ground Simulator and the base attachment 32 forward and backward movement of the Ground Simulator occurs which is beneficial to the use of the portable Ground Simulator The Ground Simulator 1 in combination with the base attachment 32 will per it forward and backward motion of the Ground Simulator in base attachment 32, and will also permit consistent frictional contact between Layers 7, 8, and 9.

When the Ground Simulator is assembled on the base attachment 32, the base attachment 32 will be fixed by any suitable means not shown, to the surface on which the Ground Simulator is to be used. Since the base attachment is fixed, the Ground Simulator now can move forwards and backwards on the base attachment as the practice shots are made because of the resilient rubber bands 47 and 48 and the operatively associated guide members 30, 31, **36*a* and 36*b***.

Figure 16:
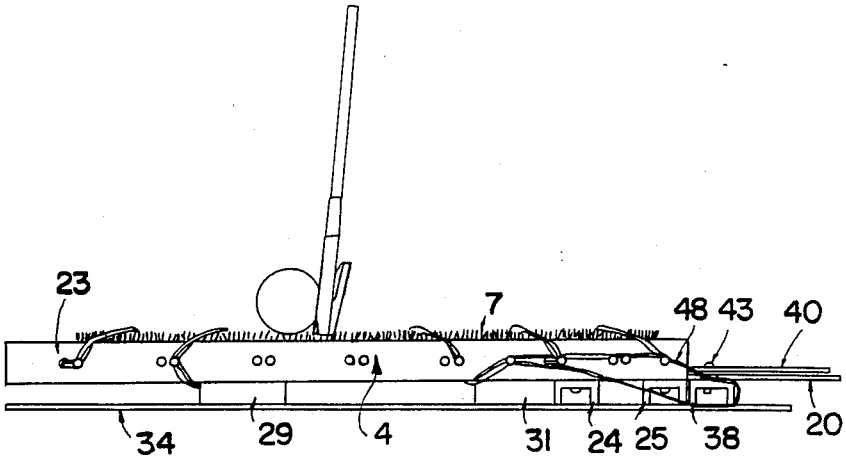
FIG. 16 is a side view of the Ground Simulator in operative relation with the base attachment showing the Ground Simulator's position with respect to the base attachment before being struck by a club head.
Figure 17:
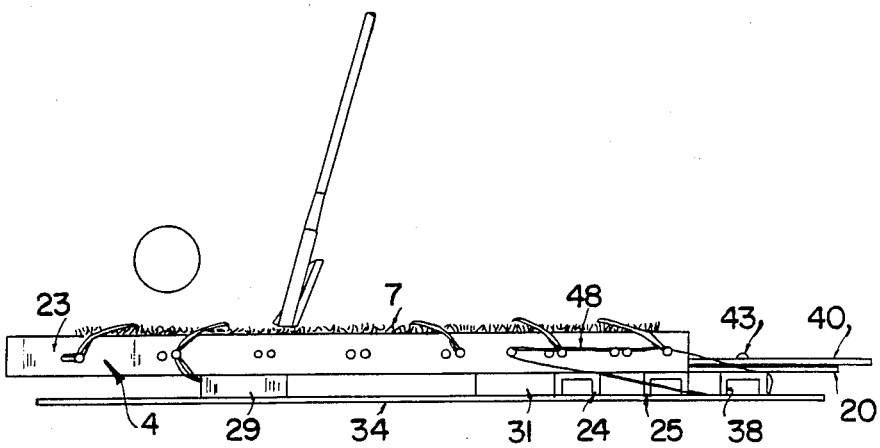
FIG. 17 is a side view of the Ground Simulator in operative relation with the base attachment illustrating the Ground Simulator's forward movement position with respect to the base attachment immediately after being struck by a club head.

FIGS. 16 and 17 illustrate the operation of the combined Ground Simulator and base attachment. Thus, when a golf club strikes the Ground Simulator 1, the Ground Simulator will slide forward immediately after the impact of the club head. However, guide members **36*a* and 36*b* and feet 30 and 31 restrict movement of the Ground Simulator 1 to a forward direction. Likewise, ramp 20 and bolts 42 and 43 keep the back end of Ground Simulator 1 from moving in anything but a forward direction. Therefore, the Ground Simulator 1 can only move in a direction generally parallel to the length of the base attachment 32. However, pulling in a direction opposite to that of the Ground Simulator's forward direction are rubber bands 47 and 48. Thus, when the practice shot is terminated except for a limited degree of inertia the forward motion of the Ground Simulator will also be terminated and the rubber bands 47 and 48 will then exert the necessary force to reverse the forward motion of the Ground Simulator 1 and will pull the Ground Simulator back in a rearward direction also generally parallel to the longitudinal line of the base attachment, because of the guide members, until the cross member 25 on the Ground Simulator frame comes into abutment with the stop member 38 on the base attachment 32**. Thus, the Ground Simulator is again placed in position for another practice shot.

STANCE AREA

Another mode of the present invention is illustrated by FIGS. 18 and 19 showing the optional stance area attachment, generally designated 53. Channel connector 55 is connected to channel member 23, thus joining the portable Ground Simulator 1 to stance area 53. The shape of channel connector 55 will be such that it will not interfere with the holding bolts 16.

Cover 54 is L-shaped and covers both channel member 23 and channel connector 55, and cover 54 also extends beyond and below channel connector 55. On top of cover 54 are hooks 59 used to hold flexible guard 57 in place. Guard 57 covers the outer edges of the top layer 7 and hides the connecting means 12, holes 6 and grommets **6*a*. The guard 57 is slidably disposed between the hooks 59. By pulling longitudinally on the guard 57 it can be slidably removed from the hook bracket 59. Connected to the other end of cover 54 is holder 58, used to operatively connect the carpet 60 of the stance area to the Ground Simulator 1**.

One purpose of the stance area is to keep the Ground Simulator 1 from moving away from the golfer during any hitting or practice shots. Because the carpet 60 is firmly connected to the Ground Simulator 1, the weight of the golfer upon carpet 60 will keep the carpet from moving and this in turn, will keep the Ground Simulator from moving after any hitting or practice shot.

The mat 56 can be used to raise the golfer to a height approximately that of the Ground Simulator 1. The mat 56 is not fixed to the carpet 60, and can be moved to the position best suited to the golfer's stance. Additionally, the mat 56 can be reversed to vary the type of stance surface from which any hitting or practice shot is made, or it can be removed to vary the height at which the shot is made. Mat 56 is formed with a standing surface 51 and frictional laYer 52 is adhesively connected to the standing surface 51. Frictional layer 52 is made of a material to keep the mat 56 from sliding on the carpet 60 when a golfer is in position on the mat. Standing surface 51 is made of material comfortable for the golfer. For example, a carpet can be used for the standing surface 51 and a spike proof rubberized material can be used for the frictional layer 52.

Thus, an improved portable golf shot hitting or practicing device has been described which has great versatility for simulating the actual ground, surface, sand or turf conditions of a golf course and for varying the condition to be simulated. Additionally, the portable Ground Simulator enables the user to vary stance and position for hitting or practicing the hitting of a particular golf shot.

It will be understood that the invention is not to be limited to the specific construction or arrangement of parts shown but that they may be widely modified within the invention defined by the Claims.

What is claimed is:

1. A golf shot practice device simulating the conditions of a natural surface comprising:
(a) a frame;
(b) a first surface layer for supporting a golf ball thereon;
(c) at least one second layer located below the top surface layer and vertically spaced therefrom so as to normally be out of contact with the first surface layer;
(d) first connecting means connecting the first surface layer to the frame and permitting the first surface layer to engage said second layer in response to the downward deflection of said first layer by the force of a swing golf club head thereagainst; and,
(e) second connecting means connecting the at least one second layer to the frame.

2. The golf shot practice device according to claim 1 wherein the first connecting means comprises first resilient means connected between the first surface layer and the frame to support the first surface layer such that it may move horizontally as well as vertically with respect to the frame.

3. The golf shot practice device according to claim 2 wherein the second connecting means comprises second resilient means connected between the at least one second layer and the frame to support the at least one second layer such that it may move horizontally as well as vertically with respect to the frame.

4. The golfshot practice device according to claim 3 wherein the first resilient means comprises a plurality of first resilient elements, each attached to the first surface layer and the frame.

5. The golf shot practice device according to claim 4 wherein the second resilient means comprises a plurality a second resilient elements, each attached to the at least one second layer and the frame.

6. The golf shot practice device according to claim 1 further comprising a ramp attached to the frame adjacent to the first surface layer to facilitate pushing a golf ball onto the first surface layer.

7. The golf shot practice device according to claim 1 wherein the at least one second layer comprises:
(a) a second surface layer disposed below and vertically spaced from the first surface layer and connected to the frame by the second connecting means;
(b) a third layer disposed below and vertically spaced from the second surface layer; and,
(c) third connecting means connecting the third layer to the frame.

8. The golf shot practice device according to claim 7 wherein the first, second and third connecting means comprises:
(a) first resilient means connected between the first surface layer and the frame to support the first surface layer such that it may move horizontally as well as vertically with respect to the frame.
(b) second resilient means connected between the second surface layer and the frame to support the second surface layer such that it may move horizontally as well as vertically with respect to the frame; and,
(c) third resilient means connected between the third layer and the frame to support the third layer on the frame.

9. The golf shot practice device according to claim 8 wherein the first, second and third resilient means each comprises, a plurality of resilient elements each attached to the respective layer and the frame.

10. The golf shot practice device according to claim 9 wherein the first surface layer is made of a carpet material.

11. The golf shot practice device according to claim 10 wherein the second surface layer is made of a carpet material.

12. The golf shot practice device according to claim 11 wherein the third layer is made of plastic.

13. The golf shot practice device according to claim 1 wherein the frame comprises:
(a) side members extending generally parallel to, but laterally spaced from opposite side of the first surface layer; and,
(b) at least one cross-member interconnecting the side members.

14. The golf practice device according to claim 13 further comprising a plurality of support feet extending downwardly from the frame to support the frame in a raised position on a base surface.

15. The golf shot practice device according to claim 14 further comprising:
(a) a generally planar base sheet member to slidably support the frame thereon;
(b) locating means on the base sheet adapted to locate the frame on the base sheet in an initial position; and,
(c) resilient attachment means attaching the frame to the base sheet urging the frame back to its initial position when it has been displaced therefrom.

16. The golf shot practice device according to claim 15 wherein the locating means comprises a stop member attached to the base sheet and adapted to contact a cross-member of the frame.

17. The golf shot practice device according to claim 16 further comprising guide members on the base sheet adapted to slidably contact the support feet on the frame so as to allow the frame to slide with respect to the base sheet along a single path.

18. The golf shot practice device according to claim 1 further comprising:
(a) a golfer stance member; and,
(b) means to attach the golfer stance member to the frame so as to prevent relative movement therebetween.

19. The golf shot practice device according to claim 18 further comprising:
(a) a golfer support mat and,
(b) means to attache the golfer support mat to the golfer stance member.

* * * * *